US008793967B2

(12) United States Patent
Edel

(10) Patent No.: US 8,793,967 B2
(45) Date of Patent: Aug. 5, 2014

(54) METHODS AND APPARATUS FOR SIMULTANEOUS PRINTING ON FRONT FACE AND FLAP OF AN ENVELOPE

(75) Inventor: Eddy Edel, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 1118 days.

(21) Appl. No.: 12/334,749

(22) Filed: Dec. 15, 2008

(65) Prior Publication Data

US 2010/0152009 A1 Jun. 17, 2010

(51) Int. Cl.
*B65B 61/02* (2006.01)

(52) U.S. Cl.
USPC ..... 53/411

(58) Field of Classification Search
USPC ..... 53/411, 460, 284.3, 569, 117, 206, 53/381.3, 381.5, 381.6; 270/58.06; 493/187, 188
See application file for complete search history.

(56) References Cited

U.S. PATENT DOCUMENTS

| | | | | |
|---|---|---|---|---|
| 4,443,211 | A * | 4/1984 | Wooley | 493/188 |
| 4,597,591 | A * | 7/1986 | Gendron et al. | 283/116 |
| 4,668,212 | A * | 5/1987 | Kotani | 493/216 |
| 4,794,409 | A * | 12/1988 | Cowger et al. | 347/87 |
| 5,071,399 | A * | 12/1991 | Ashby | 493/216 |
| 5,409,441 | A * | 4/1995 | Muscoplat | 493/223 |
| 5,555,703 | A * | 9/1996 | Gombault et al. | 53/411 |
| 6,559,970 | B1 * | 5/2003 | Yamamoto et al. | 358/1.18 |
| 7,275,743 | B2 * | 10/2007 | Mui et al. | 271/207 |
| 2001/0032033 | A1 * | 10/2001 | Krasuski et al. | 700/220 |
| 2008/0172145 | A1 * | 7/2008 | Freyburger et al. | 700/233 |

FOREIGN PATENT DOCUMENTS

| | | |
|---|---|---|
| EP | GB2311282 A | 9/1997 |
| EP | GB2335421 A | 9/1999 |

OTHER PUBLICATIONS

The European Search Report for European Patent Application No. 09168574.3.

* cited by examiner

*Primary Examiner* — Robert Long
(74) *Attorney, Agent, or Firm* — Steven J. Shapiro; Charles R. Malandra, Jr.

(57) ABSTRACT

A method includes feeding an envelope along an envelope transport path in a paper-handling machine to a flap-opening station. The method further includes opening the flap of the envelope at the flap-opening station and printing on the envelope with the flap in an open position. After printing, a collation is inserted into the envelope.

7 Claims, 4 Drawing Sheets

METHODS AND APPARATUS FOR SIMULTANEOUS PRINTING ON FRONT FACE AND FLAP OF AN ENVELOPE

FIELD OF THE INVENTION

The invention disclosed herein relates generally to creation of large batches of mail, and more specifically to printing on envelopes in inserting machines.

BACKGROUND

High-speed commercial inserting machines (hereinafter referred to as "inserters") are well-known and are capable of generating thousands of mail pieces per hour. Typically inserters assemble mail pieces by sequentially feeding envelopes to an inserting station at which a "collation" is inserted into each envelope. As is understood by those who are skilled in the art, the term "collation" refers to one or more sheets of paper (unfolded and/or folded sheets) that are stacked and/or nested compactly together to facilitate insertion of the entire group of sheets at one time into the envelope.

In some cases, pre-printed window envelopes are employed, and the addressee information is carried on one of the sheets that is inserted in such a manner as to allow the addressee information to be visible through the envelope window. In these case, no printing on the envelopes is needed during or after assembly of the mail piece. In other applications, the addressee information and/or other information is printed on the envelope as part of the process of generating the mail piece. Conventionally, this is done downstream from the point of insertion at a print station that operates so as to compensate for potential variations in thickness of the mail piece. If the print station fails to completely compensate for thickness variations, then print quality may be adversely affected.

In some applications, it may be desired to print information both on the front face of the envelope and on the envelope flap. For example, addressee information may be printed on the front face and a return address may be printed on the flap. A conventional way of accomplishing this goal may be to provide separate print engines for respectively performing the front face and flap printing.

SUMMARY

According to an aspect of the invention, a method includes feeding an envelope along an envelope transport path in a paper-handling machine to a flap-opening station. The method further includes opening the flap of the envelope at the flap-opening station. Then, with the flap in an open position, the method advances to the step of printing on the envelope in the paper-handling machine. After the printing step, a collation is inserted in the envelope.

The printing may include printing on the front face of the envelope and printing on the flap of the envelope. Both the printing on the front face and on the flap may be performed by a single top-down print engine. (As will be understood by those who are skilled in the art, a "top-down print engine" is one in which ink is emitted toward the substrate in a downward direction.)

The method may further include closing and sealing the flap of the envelope with the collation inside the envelope.

In another aspect, a method includes feeding an envelope past a print engine with a flap of the envelope in an open position, and printing information on the flap and on the front face of the envelope in a single pass of the envelope past the print engine.

The flap and the front face of the envelope may both face upwards during the feeding and printing steps. The print engine may be a top-down print engine, a laser print engine, an ink jet print engine, a thermal print engine and/or a color or monochrome print engine.

In another aspect, an apparatus includes a transport mechanism for transporting envelopes seriatim along an envelope transport path, and a flap-opening mechanism that is located at a first point along the envelope transport path. The flap-opening mechanism is for opening flaps of envelopes as the envelopes are transported along the envelope transport path. The apparatus further includes a printing mechanism that is located at a second point along the envelope transport path. The second point is downstream from the first point along the envelope transport path. The printing mechanism is for printing information on the envelopes. The apparatus further includes an inserting mechanism that is located at a third point along the envelope transport path. The third point is downstream from the second point along the envelope transport path. The inserting mechanism is for inserting a respective collation into each of the envelopes. The apparatus further includes a control mechanism that is coupled to the transport mechanism, the printing mechanism and the inserting mechanism. The control mechanism is for controlling the transport mechanism, the printing mechanism and the inserting mechanism.

The printing mechanism may include a single top-down print engine that prints in a single pass on both the flap and the front face of an envelope. The apparatus may further include a buffer for buffering the envelopes at a location downstream from the printing mechanism and upstream from the inserting mechanism. The apparatus may further include a sealing mechanism that is downstream from the inserting mechanism and is for sealing the flaps of the envelopes.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

In the present invention, printing on an envelope is performed in an inserter after the envelope flap is opened and before the collation is inserted into the envelope. Because the envelope is empty at the time of printing, the thickness of the envelope, and the precise location of the printing surface, are known in advance, and there is no need to compensate for variations in thickness of the envelope due to variations in the thickness of a collation inserted in the envelope.

In other aspects, the printing may be performed in one pass both on the envelope flap and on the front face of the envelope. As will be understood by those who are skilled in the art, the front face of the envelope is the surface upon which addressee information is customarily printed. With one-pass printing on the flap and front face, a single print engine may be employed to print both a return address (or other information) on the envelope flap and the recipient's address or other information on the front face of the envelope.

Figure 1:
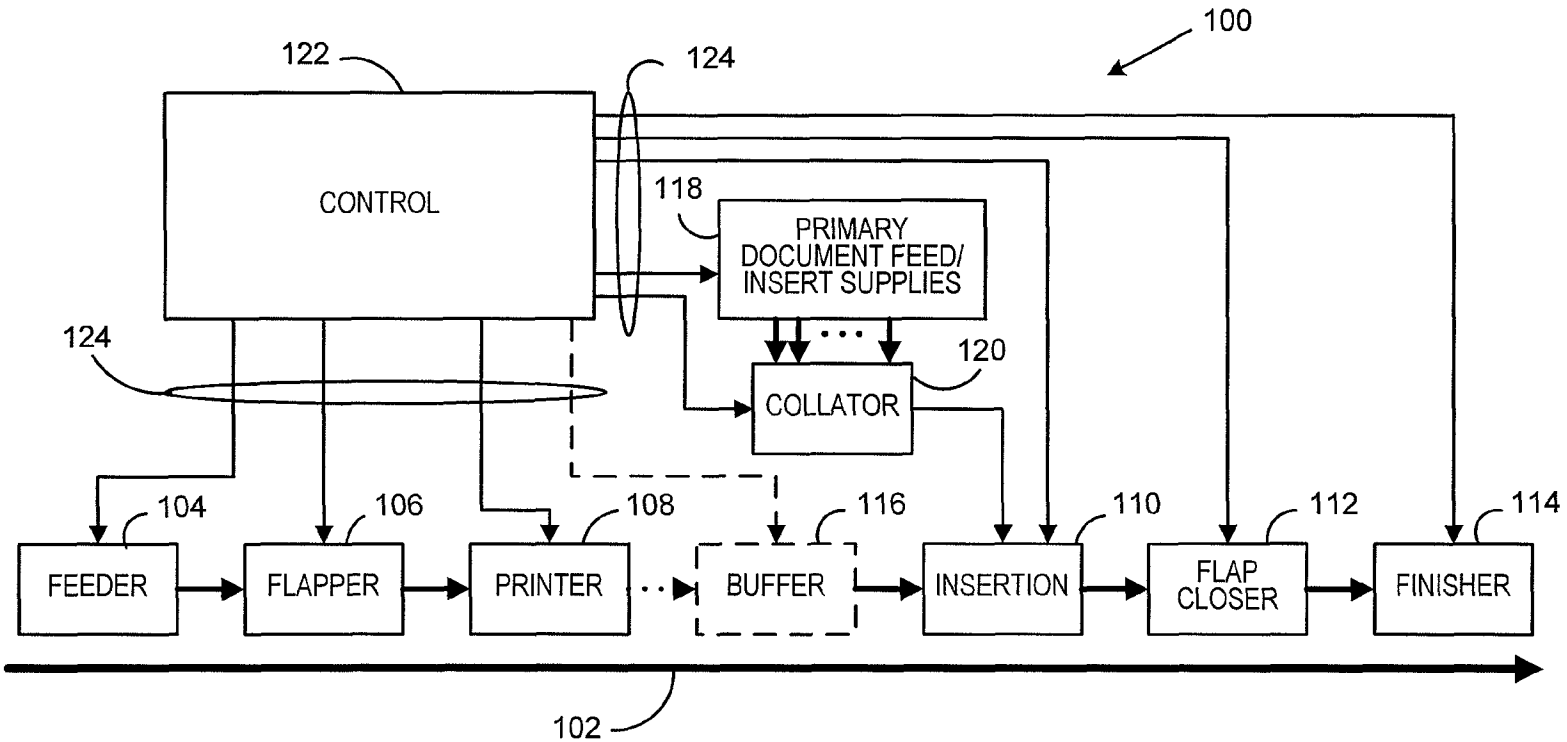
FIG. 1 is a schematic block diagram of an inserter provided in accordance with aspects of the present invention.

FIG. 1 is a schematic block diagram of an inserter 100 provided in accordance with aspects of the present invention.

In FIG. 1, reference numeral 102 generally indicates an envelope transport path that is part of the inserter 100. The arrow mark 102 that schematically represents the envelope transport path also represents the various mechanical components that engage the envelopes (not shown in FIG. 1) and transport them along the envelope transport path. It will be observed from FIG. 1 that the inserter 100 includes a sequence of components disposed along the envelope transport path 102. These components may include an envelope feeder 104, a flap-opening device 106, a printer 108, an insertion mechanism 110, a flap-closing device 112 and another mail piece finisher 114; these components may be arranged from upstream to downstream along the envelope transport path 102 in the order in which these components are listed in this sentence. In some embodiment, an envelope buffer 116 may also be included in the inserter 100 along the envelope transport path 102 downstream from the printer 108 and upstream from the insertion mechanism 110. The envelope buffer 116 may be useful in some applications to enhance the throughput of the inserter 100.

Block 118 in FIG. 1 represents one or more devices that supply cut and/or folded sheets to be inserted into the envelopes. The devices 118 may include, for example, a printer (not separately shown) that generates the primary document or cover letter that is to be inserted in each envelope. In addition, the inserter 100 includes a collator 120 that nests and/or stacks together all of the sheets to be inserted in each envelope.

Still further, the inserter 100 includes a control component 122. The control component 122 is coupled to other components of the inserter 100 by control signal paths 124. There may be additional control signal paths that are not shown in the drawing, such as control signal paths from the control component 122 to paper handling mechanisms (not separately shown) that implement the envelope transport path 102. There may also be further signal paths for transmitting to the control component 122, from various other components of the inserter 100, status signals and/or signals indicative of outputs from sensors (not shown) and the like.

Although not shown in the drawing, an envelope hopper and a stacker may also be included in the inserter 100. The envelope hopper may be positioned with or upstream from the envelope feeder 104 and may serve as a source of envelopes to be fed along the envelope transport path 102. The stacker may be positioned downstream from the finisher 114 for the purpose of receiving mailpieces that are ready for mailing.

In some embodiments, a postage meter may be positioned downstream from the finisher for the purpose of applying postage to the mail pieces assembled by the inserter 100. In some embodiments, a scale may be positioned between the finisher and the postage meter for the purpose of weighing the mail pieces as part of a process for determining the amount of postage to be applied to the mail pieces.

The envelope feeder 104 and the flap-opening device 106 may be constructed and may operate entirely in accordance with conventional practices. A number of different techniques are known, for example, for opening envelope flaps, and any of these may be employed. In some flap-opening techniques, the flap is opened while the envelope is transported along a linear path. In other flap-opening techniques, the envelope is transported along a looping path to facilitate opening of the flap. Accordingly, it should be understood that the envelope transport path 102, though depicted as linear in the drawing, need not be so. In general, wherever convenient the envelope transport path 102 may be bent, curved or looping. It should also be understood that it is contemplated to use, in the flap-opening device 106, flap-opening techniques that are developed in the future.

The printer 108 may employ any conventional printing technology, or printing technologies developed in the future. Among suitable technologies are ink jet, piezo, drop on demand or cold fusion printing, laser printing and thermal printing. Color or black and white printing may be used. Some benefits of the present invention may be realized by using a printer that is capable of printing on both the envelope front face and flap in a single pass while the front face and flap are presented in a common plane and orientation to the printer. More details with regard to the printing function will be provided below.

Each of the following components—the insertion mechanism 110, the flap-closing device 112, the finisher 114, the envelope buffer 116 (if present), the primary document/insert supply devices 118 and the collator 120—may be constructed and may operate in a conventional manner.

Figure 2:
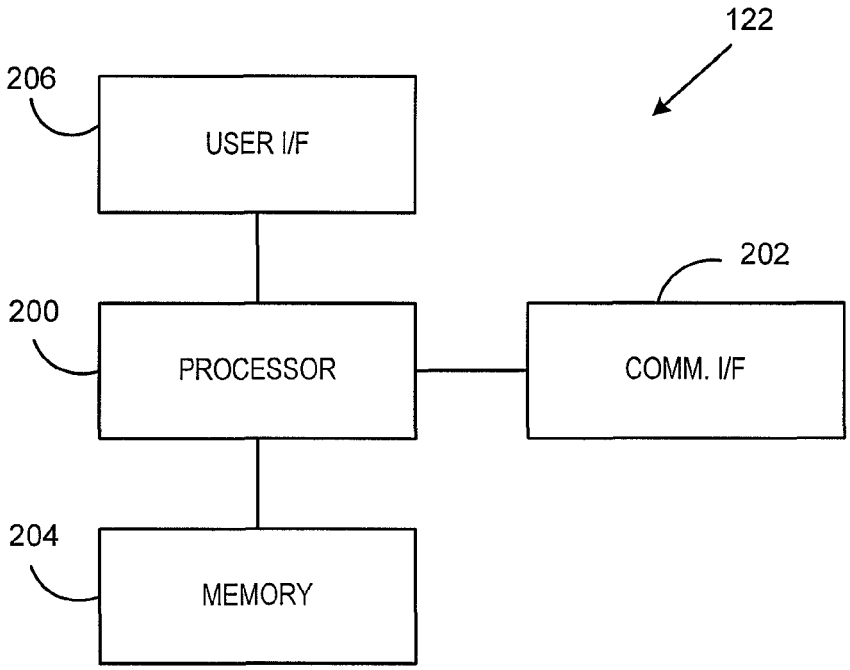
FIG. 2 is a block diagram of a control component that is part of the inserter of FIG. 1.

FIG. 2 is a block diagram of an example embodiment of the control component 122. In its hardware aspects, the control component 122 may be entirely conventional.

As depicted, the control component 122 includes a processor 200 operatively coupled to a communication device 202, to one or more memory devices 204, and to one or more user interface devices 206.

The processor 200 may be constituted by a conventional microprocessor or microcontroller.

Communication device 202 may be used to facilitate communication between the processor 200 and components of the inserter 100 that are external to the control component 122. For example, the communication device 202 may transmit, via control signal paths 124, control signals generated by the processor 200 for controlling the other components of the inserter 100. Although not shown in the drawing, the inserter 100 may also include various sensors and the like that may provide input and status signals to the processor 200 via the communication device 202.

Continuing to refer to FIG. 2, memory device 204 may comprise any appropriate information storage device, including combinations of magnetic storage devices (e.g., magnetic tape and hard disk drives), optical storage devices, and/or semiconductor memory devices such as Random Access Memory (RAM) devices and Read Only Memory (ROM) devices. At least some of these devices may be considered computer-readable storage media, or may include such media.

Memory device 204 stores one or more programs or program modules for controlling processor 200. Processor 200 performs instructions of the programs, and thereby operates in accordance with the present invention to provide functionality as described herein.

The user interface devices 206 may provide a substantially conventional user interface to allow a human operator of the inserter 100 to monitor and control operation of the inserter 100.

Figure 3:
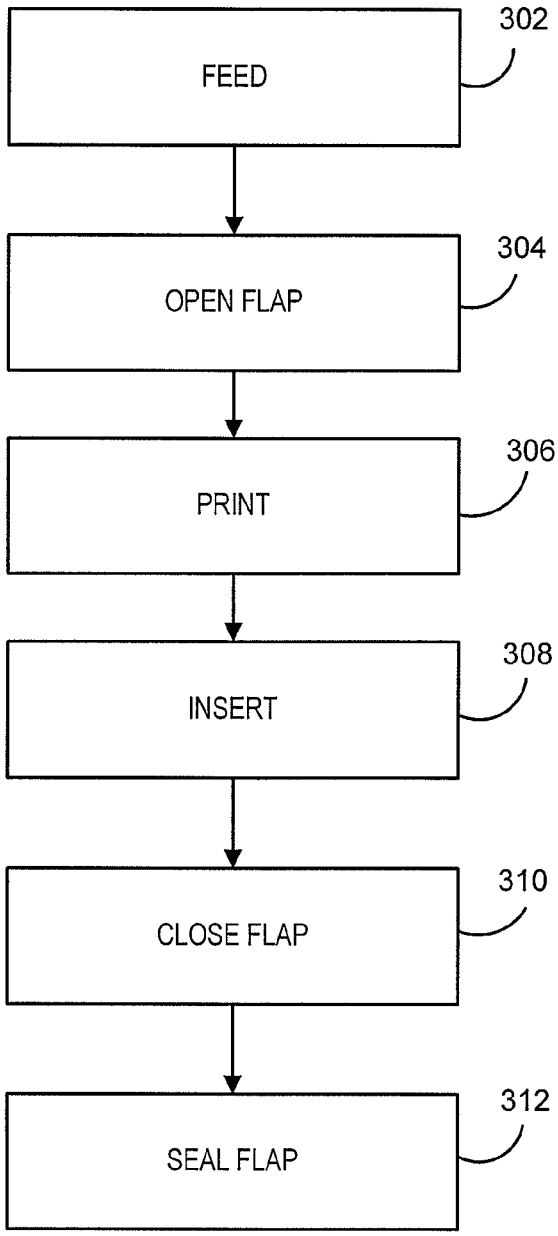
FIG. 3 is a flow chart that illustrates a process that may be performed in the inserter of FIG. 1 in accordance with aspects of the present invention.

FIG. 3 is flow chart that illustrates a process that may be performed in the inserter 100 in accordance with aspects of the present invention. At least to some extent, the process of FIG. 3 may be implemented by execution of software and/or firmware that controls the processor 200 (FIG. 2). FIGS. 4-7 are schematic sectional views showing an envelope at a sequence of stages in the process of FIG. 3.

Referring, then, to FIG. 3, at step 302 the feeder 104 (FIG. 1) feeds an envelope (not shown in FIG. 3; generally indicated by reference numeral 400 in FIG. 4) to the flap-opening device 106 (FIG. 1). The envelope 400 may be entirely conventional, including: a pouch 402, in which mail piece contents may be inserted; a front face 404, on which recipient address information and/or other information may be printed; a flap 406, for sealing the pouch 402, and on which return address information or other information may be printed; and a rear face 408. (For purposes of presentation, the thickness of the envelope has been exaggerated in the illustrations thereof.)

Figure 4:
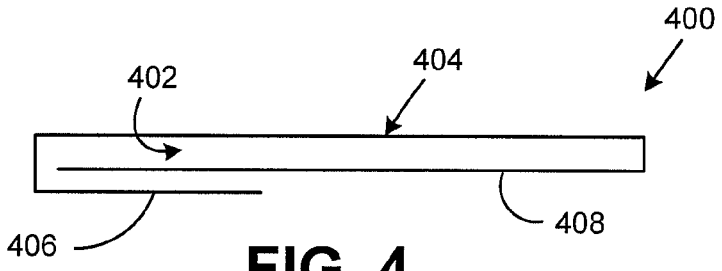
FIGS. 4-7 are schematic sectional views showing an envelope at a sequence of stages in the process of FIG. 3.

FIG. 4 illustrates the configuration of the envelope 400 at the time it is fed by the feeder 104 to the flap-opening device 106. It will be observed that the flap 406 is in a closed position relative to the rest of the envelope 400.

Figure 5:
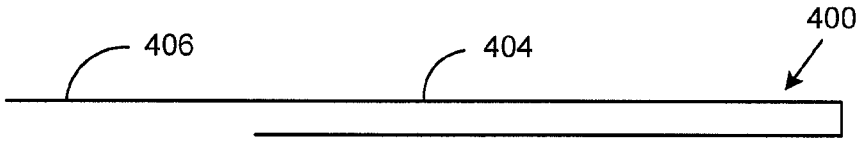

Referring again to FIG. 3, step 304 follows step 302. At step 304, the flap-opening device 106 opens the flap 406 of the envelope 400. This may, for example, be done in accordance with any known technique for automatically opening the flap of an envelope. The resulting configuration of the envelope 400 is shown in FIG. 5. From FIG. 5 it will be observed that the flap 406 is now aligned with the front face 404 of the envelope 400. As seen from this drawing, the flap 406 is in an "open position"; that is, the flap is positioned relative to the envelope pouch 402 so as to allow insertion of a collation into the envelope 400.

Continuing to refer to FIG. 3, step 306 follows step 304. At step 306 the envelope 400 is transported to and past the printer 108 (FIG. 1). The envelope 400 is in the configuration shown in FIG. 5 as this is being done. The printer 108 may be positioned above the path of travel of the envelope 400 and may print information on either or both of the front face 404 and the flap 406 of the envelope 400. In some embodiments, the printer 108 may be a top-down ink jet or bubble jet print engine and may print on both the front face 404 and the flap 406 in a single pass of the envelope 400 past the printer 108. In some embodiments, information printed on the front face 404 may include the recipient's name and address or other information. The information printed on the flap 406 may include a return address or other information. In some embodiments, some or all of the information printed on the front face 404 and/or the flap 406 may be determined, generated and/or selected based on the identity of the recipient and/or the contents of the material that will be inserted in the envelope 400.

Figure 6:
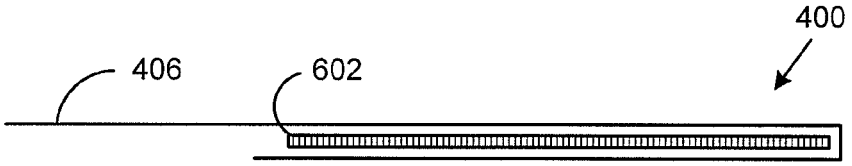

Referring again to FIG. 3, step 308 follows step 306. At step 308, the envelope 400 is transported to the insertion mechanism 110 and the insertion mechanism 110 inserts a collation in the pouch 402 of the envelope 400. The collation (schematically illustrated, and indicated by reference numeral 602, in FIG. 6) may include one or more sheets supplied by the primary document/insert supply devices 118 (FIG. 1) and collated by collator 120. The collation may include a cover letter and/or a statement and one or more additional inserts, for example. The configuration of the envelope 400 after insertion of the collation 602 is illustrated in FIG. 6. Step 308 may be performed in a conventional manner.

Continuing to refer to FIG. 3, steps 310 and 312 follow step 308. At step 310, the flap-closing device 112 (FIG. 1) closes the flap 406 of the envelope, and at step 312 the finisher 114 seals the flap 406. (In some embodiments, however, closing and/or sealing of the flap may be omitted from operation of the inserter, and the corresponding components may be omitted.) It will be appreciated that the flap 406 may carry a conventional water-activated adhesive and that the inserter 100 may include a conventional flap-moistening mechanism—which is not separately shown—and which may be provided upstream from the flap-closing device 112 or incorporated in the flap-closing device 112 or the finisher 114. Steps 310 and 312 may overlap in time, and both may be performed in a conventional manner.

Figure 7:
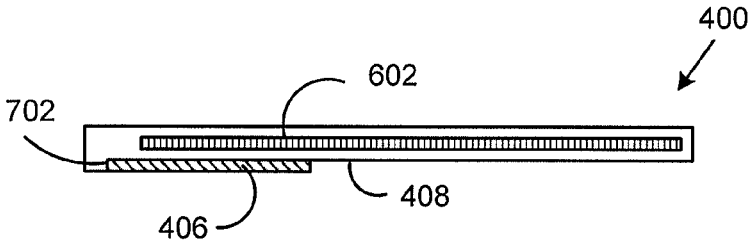

FIG. 7 illustrates the configuration of the envelope 400 (now a finished mail piece) upon completion of step 312. The bond between flap 406 and rear face 408 of the envelope 400 is schematically indicated at 702 in FIG. 7.

The illustrations of the envelope 400 and other description herein suggests that the envelope 400 may be presented to the printer 108 and other components of the inserter 100 in a face-up orientation. However, this need not necessarily be the case. For example, the envelope may be presented for printing in a vertical or in a face-down orientation. Similarly, the printer 108 need not be a top-down printer; for example, the printer may be a so-called "bottom-up" printer.

In some embodiments, the throughput of the inserter may be such that it is capable of generating tens of thousands of mail pieces per hour. That is, the principles of the present invention are applicable to high-volume production inserters. Alternatively, however, the present invention may also be applied in smaller and/or slower inserters, including table-top inserters and console inserters.

In embodiments of the inserter disclosed herein, the inserter operates to open the envelope flaps. Alternatively, however, the envelopes may be fed to the inserter with flaps pre-opened.

The invention is applicable to window envelopes, close face (no window) envelopes, and so-called "die cut" envelopes (i.e., envelopes having a window that is not closed with plastic or the like). When the envelope is a window or die-cut envelope, the inserter may still print information on the face of the envelope in some applications.

In embodiments disclosed herein, a control component embedded in the inserter is illustrated as the controller for the printer. However, in other embodiments the printer controller may be separate from the inserter. Moreover, in some embodiments the printer controller, whether or not embedded, may drive more than one printer.

In some embodiments, the printer may be constituted as a print engine that includes more than one print nozzle or print head.

In some applications of the inserter 100, the printer 108 may print on either, both or none of the front face of the envelope and the envelope flap. The printing on the front face and/or the flap may be performed on some but not all of the envelopes in a mail run. For example, the printer 108 may print on all front faces but only some flaps in a mail run.

As used herein and in the appended claims, the term "paper-handling machine" refers to an inserter or any other device that mechanically transports envelopes.

The flow chart and/or process description contained herein should not be assumed to imply a fixed order for performing process steps. Rather, process steps may be performed in any order that is practicable.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. A method comprising:

feeding an envelope past a print engine with a flap of the envelope in an open position; and printing information on the flap and on a front face of the envelope in a single pass of the envelope past the print engine.

2. The method according to claim 1, wherein the flap and the front face of the envelope both face upwards during said feeding and printing steps.

3. The method according to claim 2, wherein the print engine is a top-down print engine.

4. The method according to claim 1, wherein the print engine is laser print engine.

5. The method according to claim 1, wherein the print engine is an ink jet print engine.

6. The method according to claim 1, wherein the print engine is a thermal print engine.

7. The method according to claim 1, wherein the print engine is a color print engine.

* * * * *